US010011946B2

(12) United States Patent
Rasetto et al.

(10) Patent No.: US 10,011,946 B2
(45) Date of Patent: Jul. 3, 2018

(54) CONTINUOUS PROCESS FOR TREATING A LIGNOCELLULOSIC BIOMASS

(71) Applicant: Beta Renewables, S.p.A., Tortona (IT)

(72) Inventors: Valeria Rasetto, Tortona (IT); Gaia Passerini, Castel San Giovanni (IT); Alberto Anelli, Catiglione d'Adda (IT); Tommaso Crippa, Novara (IT)

(73) Assignee: Beta Renewables S.p.A., Tortona (IT)

( * ) Notice: Subject to any disclaimer, the term of this patent is extended or adjusted under 35 U.S.C. 154(b) by 0 days.

(21) Appl. No.: 15/512,084

(22) PCT Filed: Sep. 17, 2015

(86) PCT No.: PCT/EP2015/071277

§ 371 (c)(1),
(2) Date: Mar. 17, 2017

(87) PCT Pub. No.: WO2016/042053

PCT Pub. Date: Mar. 24, 2016

(65) Prior Publication Data

US 2017/0275817 A1 Sep. 28, 2017

(30) Foreign Application Priority Data

Sep. 19, 2014 (IT) ..... MI2014A1611

(51) Int. Cl.

| | |
|---|---|
| ***D21B 1/02*** | (2006.01) |
| ***D21C 1/02*** | (2006.01) |
| ***B01D 39/18*** | (2006.01) |
| ***D21B 1/12*** | (2006.01) |
| ***D21B 1/34*** | (2006.01) |

(52) U.S. Cl.

CPC ..... *D21B 1/026* (2013.01); *D21C 1/02* (2013.01)

(58) Field of Classification Search

CPC . D21B 1/02; D21B 1/026; D21B 1/12; D21B 1/34; D21C 1/02; B01D 39/18; B29B 2017/0244

See application file for complete search history.

(56) References Cited

U.S. PATENT DOCUMENTS

| | | | | |
|---|---|---|---|---|
| 8,771,472 | B2 | 7/2014 | Beldring et al. | |
| 2008/0054108 | A1 | 3/2008 | Matz et al. | |
| 2016/0165926 | A1* | 6/2016 | Medoff | A61Q 19/00 426/63 |
| 2017/0210032 | A1* | 7/2017 | Tamir | B29B 17/02 |
| 2017/0275817 | A1* | 9/2017 | Rasetto | D21C 1/02 |

FOREIGN PATENT DOCUMENTS

| | | | | |
|---|---|---|---|---|
| IT | WO 2016042053 | A1 * | 3/2016 | D21B 1/02 |
| WO | 2010/081476 | A1 | 7/2010 | |
| WO | 2013/105034 | A1 | 7/2013 | |

* cited by examiner

*Primary Examiner* — Jose A Fortuna
(74) *Attorney, Agent, or Firm* — Edwin A. Sisson, Attorney at Law, LLC; Jeffrey J. Banyas

(57) ABSTRACT

It is described herein a continuous process for soaking a ligno-cellulosic biomass stream in an extraction solution comprising water and dissolved water soluble species derived from a previously treated ligno-cellulosic biomass. In the process, water insoluble contaminants are separated according to their apparent mass densities. The ligno-cellulosic biomass stream may be further subjected to a second optional soaking step in a counter flow configuration. The process is useful to remove non-ligno-cellulosic water soluble compounds from the ligno-cellulosic biomass with a low consumption of water.

20 Claims, 1 Drawing Sheet

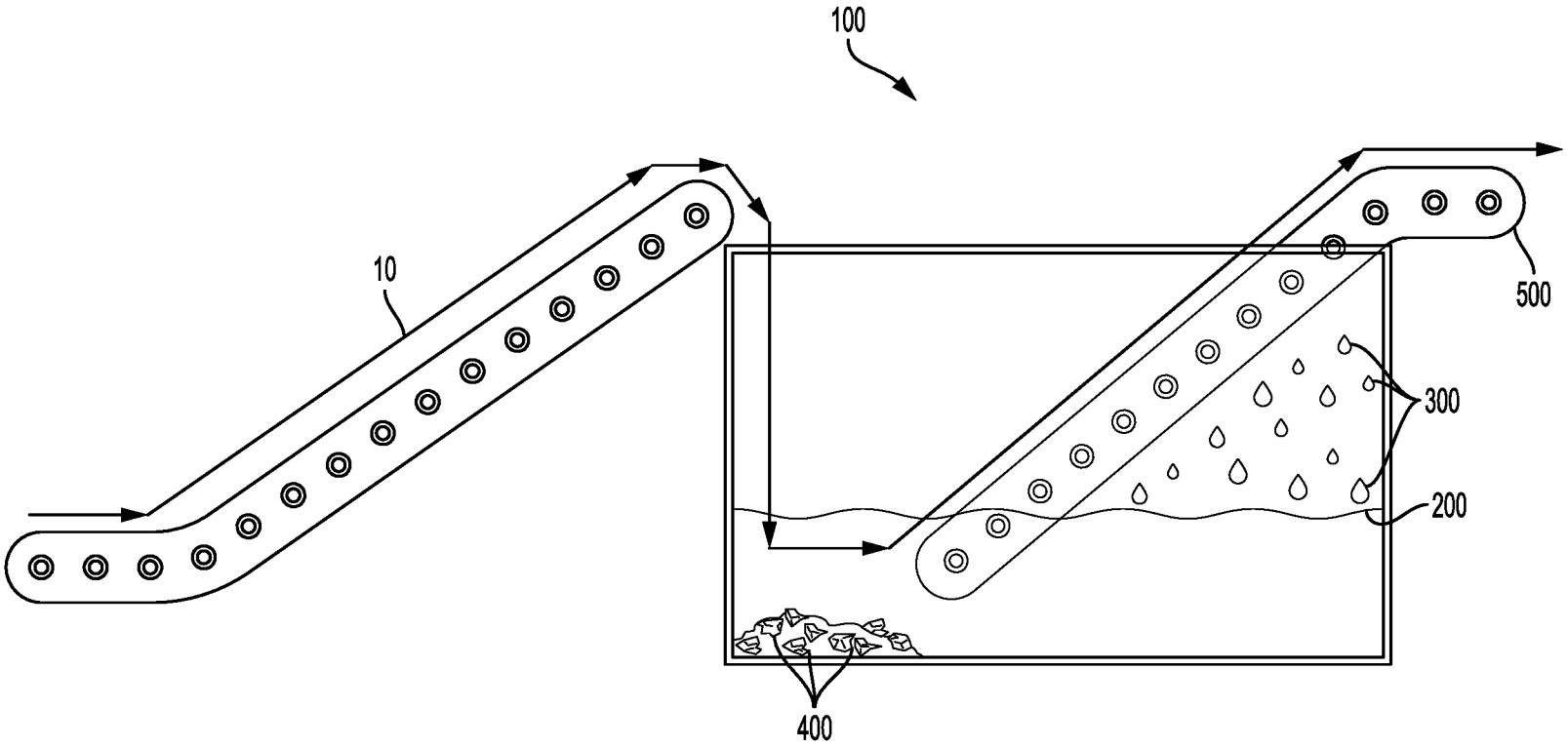
100
10
500
300
200
400

CONTINUOUS PROCESS FOR TREATING A LIGNOCELLULOSIC BIOMASS

PRIORITIES AND CROSS REFERENCES

This patent application claims priority from International Application No. PCT/EP2015/071277 filed on 17 Sep. 2015 and Italian Patent Application No. MI2014A001611 filed on 19 Sep. 2014, the teachings of both of which are incorporated herein by reference in their entirety.

BACKGROUND

Ligno-cellulosic biomasses may be converted to biochemical products and fuels by means of different conversion processes.

Before entering a conversion process, the harvested ligno-cellulosic biomass is usually subjected to an initial processing for rendering the raw ligno-cellulosic biomass compatible with the conversion process and equipments.

A problem arising in handling raw ligno-cellulosic biomasses received in the conversion plant is the presence of external contaminants, such as stones, gravel, sands, sand, dust, clay, metal objects which are present together with the ligno-cellulosic biomasses.

It is also desirable to remove inorganic components of the raw ligno-cellulosic biomass, such as silicates, salts and mineral elements, which are detrimental for the conversion process or equipment.

There is also the need to raise the water content of the raw ligno-cellulosic biomass, which in some cases are received in the conversion plant very dry.

Different equipments and processes have been developed so far for preparing the raw ligno-cellulosic biomass to be further processed.

One approach is to carry out the preparation steps sequentially. As an example, the external contaminants may be first removed from the raw ligno-cellulosic biomass, for instance by means of air floatation equipments, and metallic objects are removed by means of magnetic separation devices. Thereafter, the raw ligno-cellulosic biomass may be treated with water and optionally additives, thereby washing the biomass and increasing its water content. Different methods for washing and/or soaking the biomass are used, typically providing mechanical agitation of the ligno-cellulosic biomass. In this case, an extended biomass handling section is present in the conversion plant, said biomass handling section containing many equipments, usually connected with conveyor belts, to convey the biomass. The distributed approach increases the capital and operative costs, as well as the risk of failure.

A different approach is to integrate the preparation steps into a unique equipment. As an example, in U.S. Pat. No. 8,771,472 an apparatus and a related methods for treating material by cutting, soaking and/or washing of the material are disclosed. The apparatus comprises a receptacle, a discharge element with a vortex generator and pumping means arranged to pump fluid and material from the receptacle towards the vortex generator, wherein the vortex generator and pumping means in combination are adapted to generate a vortex in the form of a conic helix in the fluid extending into the receptacle. The pump means includes a pump arranged downstream of the discharge element that also pumps the fluid with cut material through the discharge element toward a separator that separates out a stream of fluid comprising substantially all the cut material from the fluid. The separation may be embodied in the form of a screw press, a filter or centrifuge or means of for sedimentation of the treated material and the residual stream (i.e. the fluid containing substantially no cut material) separated out in the separator is feed back into the receptacle by a recirculation flow line.

However, when the apparatus disclosed in U.S. Pat. No. 8,771,472 is used for treating a ligno-cellulosic biomass stream, such as straw stream, the pumping means are subjected to be easily clogged due to the tough, fibrous nature of the ligno-cellulosic biomass. In addition, in U.S. Pat. No. 8,771,472 the apparatuses and systems used for separating the residual stream from the fluid comprising the cut material involve a significant consumption of mechanical energy (e.g. in the case of a screw press) and/or are subjected to be clogged (e.g. in the case of a filter). Furthermore, in case sedimentation means are used for the separation, as the vortex completely mixes the solid particles in the liquid, the solid/liquid separation through sedimentation normally requires a long time.

In U.S. 2008054108 a pulper having a tank for receiving materials to be shredded and a drive having a rotating hub within the tank id disclosed. A rotor is fixed to the rotating output of the drive, the rotor comprising an annular rotatable hub and a plurality of vanes projecting generally axially from the hub. Each of the vanes has a contour that is swept back from the direction of rotation, at least adjacent the radially outermost portion thereof. The vanes have a side edge facing an axial direction and a plurality of teeth are provided on the side edge of the vanes adjacent the radially outermost portion thereof for providing rapid shredding of material with a reduced energy requirement.

WO 2010/081476 discloses an apparatus having the function of in-feeding and dewatering biomass so as to control water content in biomass before the dewatered biomass is introduced into a process reactor in a plant for the production of, for example, bio-ethanol. The in-feeding and dewatering processes are carried out at a pressure higher than or equal to the pressure inside the process reactor providing the advantage of a fluid tight sealing of the process reactor and facilitating its continuous feeding.

WO 2013/105034 discloses a composition obtained by a process for pretreatment of ligno-cellulosic biomass which allows controlling the xylose ratio of the pretreated biomass.

It is desirable that a low amount of water is used for processing of the raw ligno-cellulosic feedstock before entering the conversion process, as the water in excess has to be treated in a waste water facility. Thereby, a trade-off between amount of water used in the treatment and effectiveness of the treatment is desirable.

It is also desirable that the process uses a low amount of energy, which is both thermal energy from heating the process water and electrical energy for supplying mechanical agitation means.

SUMMARY OF THE INVENTION

It is disclosed a process for preparing a raw ligno-cellulosic biomass feedstock, as received in an industrial plant to be converted to biofuels and biochemicals.

The disclosed process achieves many technical objective: separation of external contaminants from the ligno-cellulosic biomass feedstock, removal of most of the non-ligno-cellulosic water soluble compounds in a short processing time, minimal amount of water sent to waste water treatment, low thermal and electrical energy.

The disclosed process may be implemented by means of a unique compact equipment integrating all the functionality, thereby reducing the area of the industrial site.

The disclosed process is a continuous process for treating a ligno-cellulosic raw biomass stream, comprising water insoluble contaminants and a ligno-cellulosic biomass comprised of a ligno-cellulosic component, non-ligno-cellulosic water soluble compounds and non-ligno-cellulosic water insoluble compounds, said process comprising the steps of: introducing the ligno-cellulosic raw biomass stream into a separation pool, containing an extraction solution comprising water and dissolved water soluble species and having an extraction solution density, wherein at least a portion of the extraction solution derives from the extraction of a portion of ligno-cellulosic biomass previously treated and contains dissolved water soluble species derived from the non-ligno-cellulosic water soluble compounds of the previously treated ligno-cellulosic biomass; separating the water insoluble components according to their apparent mass densities to create at least a heavy stream comprising at least a portion of the water insoluble contaminants and a light stream comprising at least a portion of the ligno-cellulosic component, wherein the apparent density of the water insolubles in the heavy stream is greater than the extraction solution density and the apparent density of the water insolubles in the light stream is lower than the extraction solution density; and removing the light stream from the separation pool, wherein the light stream is removed from the separation pool by a mechanical removal system extending to an upper position of the extraction pool with respect to the gravity, said mechanical removal system comprising a conveyor belt which extracts the light stream from an outlet zone of the separation pool and drains a dirty liquid stream while lifting the light stream to the upper position.

It is also disclosed that the temperature of the extraction solution may be in a range selected from the group of 30° C. to 100° C., 40° C. to 99° C., 40° C. to 90° C., and 50° C. to 85° C.

It is further disclosed that the ligno-cellulosic raw biomass stream may reside in the separation pool for a residence time which is in a range selected from the group consisting of 30 seconds to 300 minutes, 1 minute to 20 minutes, 2 minutes to 20 minutes, 2 minutes to 15 minutes, and 3 to 10 minutes.

It is also disclosed that the ratio by weight of the ligno-cellulosic biomass present in the separation pool to the extraction liquid in the separation pool may be less than a value selected from the group consisting of 1:1000, 1:800, 1:600, 1:400, 1:200, 1:100, 1:70, 1:50, 1:30, 1:20, and 1:10.

It is further disclosed that the process may further comprises draining a dirty liquid stream from the light stream, wherein the dirty liquid stream comprises water and at least a portion of the non-ligno-cellulosic water soluble compounds; and reintroducing at least a portion of the dirty liquid stream directly into the separation pool.

It is also disclosed that the light stream after draining has a free liquid and the percent amount of the free liquid by weight on wet basis in the light stream after draining may be less than a value selected from the group consisting of 20%, 10% and 5% of the light stream.

It is further disclosed that the light stream after draining may be substantially void of the free liquid.

It is also disclosed that the portion of the dirty liquid stream directly reintroduced into the separation pool may be greater than a value selected from the group consisting of 50%, 60%, 70% and 80% of the dirty liquid stream. It is further disclosed that the light stream may be rinsed with a rinse solution stream comprising water while draining the dirty stream from the light stream.

It is also disclosed that the temperature of the rinse solution stream may be in a range selected from the group of 30° C. to 100° C., 40° C. to 99° C., 40° C. to 90° C., and 50° C. to 85° C.

It is further disclosed that the temperature of the rinse solution stream may be greater than or equal to the temperature of the extraction liquid.

It is also disclosed that the light stream may be rinsed for a rinsing time which is a value in a range selected from the group consisting of 30 seconds to 300 minutes, 1 minute to 20 minutes, 2 minutes to 20 minutes, 2 minutes to 15 minutes, and 3 to 10 minutes.

It is further disclosed that the ratio of flow of the light stream in Kg/hour on a dry basis to the flow of the rinse solution stream in Kg/hour may be less than a value selected from the group consisting of 1:20, 1:15, 1:10, 1:7, 1:5, 1:3, and 1:1.

It is also disclosed that at least a second portion of the non-ligno-cellulosic water soluble compounds may be solubilized in the dirty liquid stream.

It is further disclosed that the rinsing of the light stream may occur in a counter-flow of the rinse solution stream with respect to the light stream and that at least a portion of the light stream may be rinsed with the rinse solution stream while being conveyed by the mechanical removal system.

It is also disclosed that the light stream after draining may be pressed to produce a pressed light stream comprising most of the solids and a released stream comprising water and additional water soluble species derived from the non-ligno-cellulosic water soluble compounds, the released stream being the liquid released from the pressing, and that the moisture content of the pressed light stream may be less than value selected from the group consisting of 40% to 75%, 40% to 70%, 45% to 65%, and 45% to 60%.

It is further disclosed that squeezing stream may be reintroduced into the separation pool.

It is also disclosed that the ligno-cellulosic biomass has a bulk density and the bulk density may be less than a value selected from the group consisting of 300 kg/m$^3$, 250 kg/m$^3$, 200 kg/m$^3$, 150 kg/m$^3$, 100 kg/m$^3$, 75 kg/m$^3$, and 50 kg/m$^3$.

It is further disclosed that the straw may be selected from the group consisting of switchgrass, *Mischantus, Arundo Donax*, sugar cane straw, bagasse, wheat straw, barley straw, and rice straw.

It is also disclosed that the contaminants may comprise at least one component selected from the group consisting of stones, silica-containing particles, sand, metal objects.

It is further disclosed that the percent amount of the contaminants in the ligno-cellulosic raw biomass stream may be less than a value selected from the group consisting of 10%, 5%, 3%, and 1%.

BRIEF DESCRIPTION OF THE FIGURES

FIG. 1 is a side cut-away view of an apparatus for conducting a process for treating a ligno-cellulosic raw biomass stream.

DETAILED DESCRIPTION

The disclosed process is a continuous process for treating a raw ligno-cellulosic biomass. A raw ligno-cellulosic biomass is one which has been harvested but not yet subjected to a conversion process such as steam or gas explosion. The raw ligno-cellulosic biomass is the ligno-cellulosic biomass as harvested, which has been optionally subjected to preliminary handling and cleaning procedures. Handling procedures are usually done to reduce the transportation costs of the biomass, such as for instance size reduction of the biomass or packing the biomass in bales. Size reduction may be done for instance by grinding, crushing or cutting the biomass. Packing the biomass in bales may reduce the volume needed to transport the biomass, and a certain compression may also be applied to the biomass.

The main objective of the disclosed process is to treat the raw ligno-cellulosic biomass feedstock as received in an industrial plant to be further converted to biofuels and biochemicals.

Preferably, the following treatment or conversion process of the ligno-cellulosic biomass stream comprises steps conducted at a pressure which is greater than atmospheric pressure, which is the pressure at which the ligno-cellulosic biomass feedstock exits the disclosed process. Thereby, the ligno-cellulosic biomass processed according to the disclosed process is then transferred from the lower pressure of this process to a higher pressure by means of an apparatus such as a plug screw feeder.

The raw ligno-cellulosic biomass stream comprises a ligno-cellulosic biomass and water insoluble contaminants.

For the scope of the disclosed process, the ligno-cellulosic biomass is comprised of a ligno-cellulosic component, non ligno-cellulosic water soluble compounds and non ligno-cellulosic water insoluble compounds.

The ligno-cellulosic component comprises carbohydrates (mainly glucans and xylans) and lignin, which may be then converted to biofuels and biochemicals. Carbohydrates are insoluble polymers of water soluble monomeric sugars (such as glucose and xylose).

The non ligno-cellulosic water soluble compounds comprise compounds different from carbohydrates and which are naturally present in the ligno-cellulosic biomass, including, among others: organic and inorganic salts of cations and anions including sodium, calcium, potassium, ammonium, magnesium; waxes and extractives in general, when solubilized in water, water soluble species are derived from these compounds by direct solubilization or also by more complex reactions.

Water soluble compounds are defined as follow: an amount of 50 g of ligno-cellulosic biomass is dispersed in 250 mL of distilled water at 65° C. and shaked for 5 minutes. The slurry is filtered with a colander and the liquid fraction is collected and analyzed. Water soluble compounds are the compounds in the liquid fraction having a concentration greater than 0 g/l.

The non ligno-cellulosic water insoluble compounds comprise compounds, such as intrinsic silica present in the ligno-cellulosic biomass, which are not solubilized in water at the conditions of the disclosed process.

The water insoluble contaminants comprise for instance stones, gravel, sands, sand, dust, clay, silica and silicates in general, and metal objects, which are collected with the ligno-cellulosic biomass in harvesting and handling operation of the ligno-cellulosic biomass and it is desirable that they are separated from the ligno-cellulosic biomass before feeding the ligno-cellulosic biomass to downstream devices, which could be damaged. The size of water insoluble contaminants may vary from very small particles, in the sub millimeter range as in the case of sand, to many centimeters, as in the case of stones. They are in general mixed with the ligno-cellulosic biomass and may adhere on the surface of the ligno-cellulosic biomass or be present in bundles of the ligno-cellulosic biomass. In these cases, separation from the ligno-cellulosic biomass may be difficult.

Preferably, the percent amount of the contaminants in the ligno-cellulosic raw biomass stream is less than a 10%, 5%, 3%, and 1%.

Ligno-cellulosic biomasses are described in details in a following section.

Even if any kind of ligno-cellulosic biomass may be treated according to the disclosed process, the advantages are evident in the case of a ligno-cellulosic biomass comminuted in chips, wherein the chips are characterized by a low bulk density. The bulk density is defined as the mass of many particles of the material divided by the total volume they occupy. The total volume includes particle volume, inter-particle void volume, and internal pore volume. Bulk density is not an intrinsic property of a material; it can change depending on how the material is handled. The bulk density is determined according to the standard ASABE S 269.4 DEC91 (ASABE standards, American Society of Agricultural and Biological Engineers), which defines methods and procedures for measuring unit density, bulk density, durability, and moisture content of various densified products composed mainly of forage, woody crops, or other fibrous and non-fibrous material for bulk handling in the feed and non-feed industries. The bulk density may be less than 300 $kg/m^3$, preferably less than 250 $kg/m^3$, more preferably less than 200 $kg/m^3$, even more preferably less than 150 $kg/m^3$, even yet more preferably less than 100 $kg/m^3$, most preferably less than 75 $kg/m^3$, being less than 50 $kg/m^3$ the even most preferred value. The bulk density may be greater than 10 $kg/m^3$, preferably greater than 15 $kg/m^3$, more preferably greater than 20 $kg/m^3$. The bulk density is measured at a moisture content of 10%.

Even if the disclosed process may feed comminuted ligno-cellulosic biomass composed by chips of any shape, the advantages are evident in the case of elongated chips. The comminuted ligno-cellulosic feedstock may be characterized by the mean aspect ratio of the chips, wherein the aspect ratio of a chip is defined as the ratio of its longest size and the mean size in the section transversal to the longest size. The average is done on a sampling of the feedstock having a statistical relevance. As an example, in the case of wheat straw, the chip may be as long as some tens of centimeter and the mean transversal size is typically a few millimeters. The mean aspect ratio may be more than 3:1, preferably more than 5:1, more preferably more than 10:1, even more preferably more than 15:1, even yet more preferably more than 20:1, most preferably more than 30:1, being more than 40:1 the even most preferred value.

Preferably, the ligno-cellulosic feedstock is selected from the group consisting of switchgrass, Mischantus, *Arundo Donax*, sugar cane straw, bagasse, wheat straw, barley straw, and rice straw.

According to one objective of the invention, the water insoluble contaminants are separated from the ligno-cellulosic biomass by means of apparent mass density, thereby with no or minimal use of external mechanical energy.

According to another objective of the invention, at least a portion of the water soluble non-ligno-cellulosic compounds from the ligno-cellulosic biomass are removed by solubilization in an extraction solution, wherein water soluble species derived from the ligno-cellulosic biomass stream are accumulated. Stated in other words, the ligno-cellulosic biomass is treated in a dirty water solution, wherein a previous portion has been previously treated, thereby reducing water consumption.

According to a further objective of the invention, the free liquid in the ligno-cellulosic biomass stream removed from the separation pool is separated by means of draining and reintroduced directly into the separation pool, again with minimal use of mechanical energy.

According to a further objective of the invention, the ligno-cellulosic biomass stream removed from the separation pool is rinsed with a low flow of a clean rinse solution stream, which is preferably introduced into the separation pool to dilute the extraction solution, thereby with minimal use of net clean water needed for running the whole process.

The disclosed process is a continuous process, wherein the raw ligno-cellulosic biomass stream is introduced in a separation pool to create a heavy stream comprising at least a portion of the water insoluble contaminants and a light stream comprising at least a portion of the ligno-cellulosic component. In order for the disclosed process to be continuous, it is not necessary that the raw ligno-cellulosic biomass stream is continuously introduced into the separation pool, but it can be introduced at steady aliquots or pulses. Thus there are moments when there is no raw ligno-cellulosic biomass entering the separation pool. But, over time, the total mass introduced into the separation pool equals the total mass removed from the separation pool. One distinguishing feature between a continuous and a batch process is that, in a continuous process, the separation step is occurring or progressing at the same time that either the raw ligno-cellulosic biomass is introduced into the separation pool and/or the light stream is removed from the separation pool. Another way to state this is that the separation in the separation pool occurs while simultaneously, or at the same time, removing the light stream from the separation pool. Such removal is done in a continuous manner which includes an aliquot or pulse removal.

The separation pool may be of any of size and shape suitable for the scope of the disclosed process. Preferably, the separation pool has an elongated horizontal section, with a main dimension, or length, which may be between 2 m and 100 m, preferably between 4 m and 80 m, even more preferably between 4 m and 40 m.

The horizontal section of the separation pool may have a rectangular-like shape, which may be modified for instance for orienting the ligno-cellulosic biomass toward a specific region of the separation pool or preventing accumulation of the ligno-cellulosic biomass in some region of the separation pool.

The height of the separation pool may be from 10 cm to 10 m, preferably between 50 cm and 6 m, more preferably between 1 m and 5 m, and most preferably between 2 m and 4 m. The height of the separation pool may not be uniform, and in this case the height corresponds to the minimum height of the pool.

The separation pool may be an open pool, with a free surface of the extraction solution exposed to the external environment, or a closed pool, with a cover to insulate the extraction solution from the external environment.

The extraction solution contained in the separation pool comprises water and water soluble compounds which have been solubilized by the previous treatment of a portion of the ligno-cellulosic biomass.

The extraction liquid may fill completely the separation pool, as in the case of a closed pool, or it may partly fill the separation pool, provided that the height of the extraction liquid is sufficient to separate the water insoluble contaminants according to the disclosed process.

In the case that the raw ligno-cellulosic biomass stream is a straw compacted in bales, the bales are preferably disaggregated for introducing the loose raw ligno-cellulosic biomass stream into the separation pool.

The raw ligno-cellulosic biomass stream is preferably introduced into the separation pool as a dry biomass, meaning that no free liquid in present in the incoming stream. The moisture content in this case is preferably less than 50%, more preferably less than 30%, even more preferably less than 20%, and most preferably less than 10%. In another embodiment, the raw ligno-cellulosic biomass stream is introduced into the separation pool as a slurry stream, mixed with a liquid comprising water.

If the separation pool is open-type, the raw ligno-cellulosic biomass stream is preferably introduced into the separation pool by gravity through the free surface of the extraction liquid, for instance by means of a conveyor belt, and it may be spread on a wide portion or, preferably, on a delimited portion of the free surface.

If the separation pool is closed-type, the raw ligno-cellulosic biomass stream may be introduced by forced conveying, for instance by means of a screw conveyor, below the maximum height of the extraction solution, which corresponds to the free surface of the extraction liquid in the case that the separation pool is open.

As shown in FIG. 1, in the separation pool (100), the water insoluble components of the raw ligno-cellulosic biomass stream (10) are separated according to their apparent mass densities, preferably via gravity settling, in the extraction solution (200). It is noted that the apparent mass density in the extraction solution is different from the bulk density as defined by reference standard ASAE 269.4, because the extraction solution fills interstitial voids and it may also penetrate at least partially into the pores of the biomass. The apparent mass density in the extraction solution may be defined according to the ASAE 269.4, with the exception that the biomass is inserted into a container filled with extraction solution instead of air. The raw ligno-cellulosic biomass in the separation pool may comprise bundles of ligno-cellulosic biomass, wherein particles of insoluble contaminants are included. For the scope of the disclosed separation, the bundle is separated according to its own apparent mass density. The water insoluble components, including bundles of ligno-cellulosic biomass, are thereby separated by buoyancy into at least a heavy stream (400), deposited at the bottom of the separation pool, and comprising at least the majority of the water insoluble contaminants, and a light stream, floating at the top of the separation pool, and comprising the majority of the ligno-cellulosic biomass. The heavy stream may further comprise a portion of the ligno-cellulosic biomass, which is preferably less than 15%, more preferably less than 10%, even more preferably less than 5% and most preferably less than 3% by weight on a dry basis of the ligno-cellulosic biomass entering the separation pool. The light stream may further comprise a portion of the water insoluble contaminants, which is preferably less than 15%, more preferably less than 10%, even more preferably less than 5% and most preferably less than 3% by weight on a dry basis of the water insoluble contaminants entering the separation pool.

Separation of the water insoluble components may be promoted by mechanical agitation of the raw ligno-cellulosic biomass in the separation pool, for instance by means of paddle wheels. Separation may also be promoted by gas floatation by injecting gas bubbles into the extraction solution. The small bubbles adhere to the suspended bundles causing the suspended bundles to float to the surface of the extraction solution. Preferred gas is air or nitrogen.

The heavy stream deposited at the bottom of the extraction pool may be removed by means of mechanical means such as a paddle conveyor belt, or by gravity.

Besides separating the water insoluble contaminants, a portion of the non ligno-cellulosic water soluble compounds contained in the ligno-cellulosic biomass are solubilized in the extraction solution, thereby adding new water soluble species to the extraction solution. A small amount of the carbohydrates of the ligno-cellulosic component may be solubilized to soluble sugars in the extraction solution, depending on the temperature of the extraction solution and the residence time of the ligno-cellulosic biomass in the separation pool. Preferably, the process conditions are such that the most portion of the water soluble compounds are solubilized in the extraction water while no significant solubilization of the carbohydrates occurs.

Mechanical agitation may be provided to further improve solubilization of the water soluble compounds.

The temperature of the extraction solution may be between 30° C. and 100° C., preferably between 40° C. and 99° C., more preferably between 40° C. and 90° C., and most preferably between 50° C. and 85° C.

The residence time of the ligno-cellulosic biomass in the extraction solution may be between 30 seconds and 300 minutes, preferably between 1 minute and 20 minutes, more preferably between 2 minute and 20 minutes, even more preferably between 2 minutes and 15 minutes, and most preferably between 3 and 10 minutes. The residence time may be evaluated by tracing a portion of the ligno-cellulosic biomass in the separation pool.

The separation and solubilization step are preferably conducted in a great excess of extraction solution with respect to the amount of ligno-cellulosic biomass present in the separation pool. Preferably the ratio by weight of the ligno-cellulosic biomass present in the extraction pool to the extraction liquid in the separation pool is less than a value selected from the group consisting of 1:1000, 1:800, 1:600, 1:400, 1:200, 1:100, 1:70, 1:50, 1:30, 1:20, and 1:10. The amount of extraction solution in the separation pool is controlled by regulating the flows of streams entering and exiting the separation pool.

The light stream may be conveyed toward an outlet region of the light stream by means a mechanical system, which may comprise a paddle conveyor belt (500), or a paddle wheel, or both. A net flow of the extraction solution in the separation pool may also be used. In this case, the extraction solution flows from an inlet of the extraction solution to an outlet of the extraction solution, wherein it is removed and recirculated back into the extraction pool from the inlet.

Passive means, such as fixed barriers may be present in the separation pool to orient and accumulate the light stream toward the outlet region of the light stream, preventing the accumulation of the light stream in dead zones of the extraction pool.

The light stream is removed from the separation pool, preferably from an outlet of the light stream positioned in or close to the outlet region of the light stream. The light stream is removed from the separation pool in the form of a diluted slurry with a portion of the extraction solution, and it is drained to separate a dirty liquid stream (300) comprising at least a portion of the free liquid of the light stream slurry. The dirty liquid stream comprises water and non-ligno-cellulosic water soluble compounds, and may further comprise some insoluble components. Separation occurs under the action of gravity and the separated dirty liquid stream, which is approximately at the same temperature of the extraction solution in the separation pool, is introduced into the separation pool without any further processing step. Stated in another way, there is a continuous draining of the liquid dirty stream into the separation pool.

A preferred way to realize the continuous draining is to remove the light stream from the extraction pool by means of a mechanical removal system connected to the outlet of the light stream and extending to an upper position of the extraction pool with respect to the gravity. Preferably, the mechanical removal system comprises a conveyor belt, more preferably a paddle conveyor system, which extracts the light stream slurry from an outlet zone of the separation vessel and drains the dirty liquid stream while lifting the light stream to the upper position. Holes may be suitable located on the conveyor belt to promote draining of the free liquid.

In an embodiment, all the dirty liquid stream is reintroduced into the separation pool. In another embodiment it is reintroduced at least 50% by weight, more preferably at least 60%, even more preferably at least 70% and most preferably at least 80% portion of the dirty liquid stream. One reason to remove a portion of the dirty liquid stream from the process is to prevent the excessive accumulation of the water soluble species derived from the non-ligno-cellulosic water soluble compounds in the extraction solution.

As draining removes most the free liquid in the light stream slurry, the light stream after draining has a low content of free liquid, which is preferably less than 20%, more preferably less 10%, and most preferably less than 5% weight of the light stream after draining on wet basis. In a preferred embodiment, the light stream after draining is substantially void of free liquid, that is the free liquid is less than 1% by weight. Free liquid is the liquid which is separated by decanting an aliquot of the light stream after draining in a decanter for 1 hour.

As a portion of the extraction solution is removed from the separation pool with the light stream and only partly reintegrated by the dirty liquid stream, a replenishment liquid comprising water may be added to the extraction solution. The replenishment liquid is preferably clean water and dilute the concentration of water soluble species in the extraction pool.

A stream of the extraction solution is discarded from the extraction vessel and it may also be regulated to maintain the electrical conductivity in the target range. The stream may be removed from a dedicated outlet or together with the soaked ligno-cellulosic biomass removed from the extraction vessel. The process may be characterized by the total amount of extraction solution discarded from the process, in all form including sludge, for treating a Kg of ligno-cellulosic biomass on a dry basis. The total amount of extraction solution discarded from the process is preferably less than 51/Kg, more preferably less than 41/Kg, even more preferably less than 31/Kg, even yet more preferably less than 21/Kg, and most preferably less than 11/Kg per Kg of ligno-cellulosic biomass on a dry basis.

The stream of the extraction solution discarded from the process may be sent to a waste water treatment facility.

The separation pool may also comprise means to heat the extraction solution, such as for instance a piping system in thermal communication with the extraction solution. The replenishment water may be inserted at a temperature which is greater that the temperature of the extraction solution to compensate heat losses.

As the ligno-cellulosic biomass is treated with the dirty extraction solution containing accumulated water soluble species to reduce water consumption, in a preferred embodiment the light stream is rinsed with a rinse solution stream while draining the dirty liquid stream from the light stream. The rinse solution stream comprises water and it is in general more clean than the extraction solution. In this way, at least a portion of water soluble species which have been solubilized but may adhere to the ligno-cellulosic component are removed from the light stream. In this case, the dirty liquid stream comprises the drained rinse solution, which is introduced into the separation pool further diluting the extraction solution.

In a preferred embodiment, the light stream is rinsed in a limited flow of rinsed solution stream, thereby the discloses process minimize the total amount of water needed for treating the ligno-cellulosic biomass. The ratio of the flow of the light stream in Kg/hour on a dry basis to the flow of the rinse solution stream in Kg/hour is less than 1:20, preferably less than 1:15, more preferably less than 1:10, even more preferably less than 1:7, 1:5, even yet more preferably less than 1:3, and most preferably less than 1:1.

Preferably the rinse solution stream is injected in a counter-flow configuration with respect to the light stream, and it may be injected through one or more injection points while the light stream is conveyed by the mechanical removal system.

The rinse solution stream may be at a temperature between 30° C. and 100° C., preferably between 40° C. and 99° C., more preferably between 40° C. and 90° C., and most preferably between 50° C. and 85° C.

In an embodiment, the temperature of the rinse solution stream is greater than or equal to the temperature of the extraction liquid, so as to preserve the temperature of the extraction solution in the separation pool.

The light stream is rinsed for a rinsing time which is a value in a range selected from the group consisting of 30 seconds to 300 minutes, 1 minute to 20 minutes, 2 minutes to 20 minutes, 2 minutes to 15 minutes, and 3 to 10 minutes. The light stream may be a significant portion of the residence time of the ligno-cellulosic biomass in the separation pool.

Preferably, the rinse time is in a range between 1% and 80%, more preferably between 5% and 70%, even more preferably between 10% and 60%, and most preferably between 20% and 50% of the residence time. Thereby, an additional portion of the non-ligno-cellulosic water soluble compounds may be further solubilized during rinsing and removed from the light stream.

Even if the light stream after draining contains few or no free liquid, the moisture content is still high, being the light stream soaked with the extraction solution. The moisture content may be a value in a range selected from the group consisting of 70% to 95%, preferably of 70% to 90%, more preferably of 75% to 95%, and most preferably of 75% to 90%.

The moisture content of the light stream may be further reduced by pressing the light stream by means of a compression device, or presser, which releases at least a portion of remnant free and soaked liquids preferably in a continuous way. The light stream is separated into at least a released stream comprising water and additional water soluble species and a pressed light stream comprising the ligno-cellulosic biomass. The released stream may further comprise a portion of solids and may be reintroduced into the separation pool, eventually after removing at least a portion of the solids for instance by means of sedimentation. The moisture content of the pressed light stream is preferably a value in a range selected from the group consisting of 40% to 75%, 40% to 70%, 45% to 65%, and 45% to 60%. Preferably, the press comprises a compression screw located in a cylindrical housing having an annular filter screen to remove liquids. The pressed light stream may then feed a plug screw feeder to enter a conversion process at pressurized conditions to produce biofuels and biochemicals.

Ligno-Cellulosic Biomass

In general, a ligno-cellulosic feedstock, indicated also as ligno-cellulosic biomass can be described as follows:

Apart from starch, the three major constituents in plant biomass are cellulose, hemicellulose and lignin, which are commonly referred to by the generic term lignocellulose. Polysaccharide-containing biomasses as a generic term includes both starch and ligno-cellulosic biomasses. Therefore, some types of feedstocks can be plant biomass, polysaccharide containing biomass, and ligno-cellulosic biomass which may or may not contain starch.

Polysaccharide-containing biomasses according to the present invention include any material containing polymeric sugars e.g. in the form of starch as well as refined starch, cellulose and hemicellulose.

Relevant types of ligno-cellulosic feedstock for deriving the claimed invention may include biomasses derived from agricultural crops selected from the group consisting of starch containing grains, refined starch; corn stover, bagasse, straw e.g. from rice, wheat, rye, oat, barley, rape, sorghum; softwood e.g. *Pinus sylvestris, Pinus radiate*; hardwood e.g. *Salix* spp. *Eucalyptus* spp.; tubers e.g. beet, potato; cereals from e.g. rice, wheat, rye, oat, barley, rape, sorghum and corn; waste paper, fiber fractions from biogas processing, manure, residues from oil palm processing, municipal solid waste or the like. Although the experiments are limited to a few examples of the enumerated list above, the invention is believed applicable to all the member of the list.

In one embodiment, the ligno-cellulosic biomass feedstock used in the process is from the family usually called grasses. The proper name is the family known as Poaceae or Gramineae in the Class Liliopsida (the monocots) of the flowering plants. Plants of this family are usually called grasses, or, to distinguish them from other graminoids, true grasses. Bamboo is also included. There are about 600 genera and some 9,000-10,000 or more species of grasses (Kew Index of World Grass Species).

Poaceae includes the staple food grains and cereal crops grown around the world, lawn and forage grasses, and bamboo. Poaceae generally have hollow stems called culms, which are plugged (solid) at intervals called nodes, the points along the culm at which leaves arise. Grass leaves are usually alternate, distichous (in one plane) or rarely spiral, and parallel-veined. Each leaf is differentiated into a lower sheath which hugs the stem for a distance and a blade with margins The leaf blades of many grasses are hardened with silica phytoliths, which helps discourage grazing animals. In some grasses (such as sword grass) this makes the edges of the grass blades sharp enough to cut human skin. A membranous appendage or fringe of hairs, called the ligule, lies at the junction between sheath and blade, preventing water or insects from penetrating into the sheath.

Grass blades grow at the base of the blade and not from elongated stem tips. This low growth point evolved in response to grazing animals and allows grasses to be grazed or mown regularly without severe damage to the plant.

Flowers of Poaceae are characteristically arranged in spikelets, each spikelet having one or more florets (the spikelets are further grouped into panicles or spikes). A spikelet consists of two (or sometimes fewer) bracts at the base, called glumes, followed by one or more florets. A floret consists of the flower surrounded by two bracts called the lemma (the external one) and the palea (the internal). The flowers are usually hermaphroditic (maize, monoecious, is an exception) and pollination is almost always anemophilous. The perianth is reduced to two scales, called lodicules, that expand and contract to spread the lemma and palea; these are generally interpreted to be modified sepals.

The fruit of Poaceae is a caryopsis in which the seed coat is fused to the fruit wall and thus, not separable from it (as in a maize kernel).

There are three general classifications of growth habit present in grasses; bunch-type (also called caespitose), stoloniferous and rhizomatous.

The success of the grasses lies in part in their morphology and growth processes, and in part in their physiological diversity. Most of the grasses divide into two physiological groups, using the C3 and C4 photosynthetic pathways for carbon fixation. The C4 grasses have a photosynthetic pathway linked to specialized Kranz leaf anatomy that particularly adapts them to hot climates and an atmosphere low in carbon dioxide.

C3 grasses are referred to as "cool season grasses" while C4 plants are considered "warm season grasses". Grasses may be either annual or perennial. Examples of annual cool season are wheat, rye, annual bluegrass (annual meadowgrass, *Poa annua* and oat). Examples of perennial cool season are orchard grass (cocksfoot, *Dactylis glomerata*), fescue (*Festuca* spp), Kentucky Bluegrass and perennial ryegrass (*Lolium perenne*). Examples of annual warm season are corn, sudangrass and pearl millet. Examples of Perennial Warm Season are big bluestem, indian grass, bermuda grass and switch grass.

One classification of the grass family recognizes twelve subfamilies: These are 1) anomochlooideae, a small lineage of broad-leaved grasses that includes two genera (*Anomochloa, Streptochaeta*); 2) Pharoideae, a small lineage of grasses that includes three genera, including Pharus and Leptaspis; 3) Puelioideae a small lineage that includes the African genus *Puelia;* 4) Pooideae which includes wheat, barley, oats, brome-grass (*Bronnus*) and reed-grasses (*Calamagrostis*); 5) Bambusoideae which includes bamboo; 6) Ehrhartoideae, which includes rice, and wild rice; 7) Arundinoideae, which includes the giant reed and common reed; 8) Centothecoideae, a small subfamily of 11 genera that is sometimes included in Panicoideae; 9) Chloridoideae including the lovegrasses (*Eragrostis*, ca. 350 species, including teff), dropseeds (*Sporobolus*, some 160 species), finger millet (*Eleusine coracana* (L.) Gaertn.), and the muhly grasses (*Muhlenbergia*, ca. 175 species); 10) Panicoideae including panic grass, maize, sorghum, sugar cane, most millets, fonio and bluestem grasses; 11) Micrairoideae and 12) Danthoniodieae including pampas grass; with *Poa* which is a genus of about 500 species of grasses, native to the temperate regions of both hemispheres.

Agricultural grasses grown for their edible seeds are called cereals. Three common cereals are rice, wheat and maize (corn). Of all crops, 70% are grasses.

Sugarcane is the major source of sugar production. Grasses are used for construction. Scaffolding made from bamboo is able to withstand typhoon force winds that would break steel scaffolding. Larger bamboos and *Arundo donax* have stout culms that can be used in a manner similar to timber, and grass roots stabilize the sod of sod houses. *Arundo* is used to make reeds for woodwind instruments, and bamboo is used for innumerable implements.

Another ligno-cellulosic biomass feedstock may be woody plants or woods. A woody plant is a plant that uses wood as its structural tissue. These are typically perennial plants whose stems and larger roots are reinforced with wood produced adjacent to the vascular tissues. The main stem, larger branches, and roots of these plants are usually covered by a layer of thickened bark. Woody plants are usually either trees, shrubs, or lianas. Wood is a structural cellular adaptation that allows woody plants to grow from above ground stems year after year, thus making some woody plants the largest and tallest plants.

These plants need a vascular system to move water and nutrients from the roots to the leaves (xylem) and to move sugars from the leaves to the rest of the plant (phloem). There are two kinds of xylem: primary that is formed during primary growth from procambium and secondary xylem that is formed during secondary growth from vascular cambium.

What is usually called "wood" is the secondary xylem of such plants.

The two main groups in which secondary xylem can be found are:

1) conifers (Coniferae): there are some six hundred species of conifers. All species have secondary xylem, which is relatively uniform in structure throughout this group. Many conifers become tall trees: the secondary xylem of such trees is marketed as softwood.

2) angiosperms (Angiospermae): there are some quarter of a million to four hundred thousand species of angiosperms. Within this group secondary xylem has not been found in the monocots (e.g. Poaceae). Many non-monocot angiosperms become trees, and the secondary xylem of these is marketed as hardwood.

The term softwood is used to describe wood from trees that belong to gymnosperms. The gymnosperms are plants with naked seeds not enclosed in an ovary. These seed "fruits" are considered more primitive than hardwoods. Softwood trees are usually evergreen, bear cones, and have needles or scale like leaves. They include conifer species e.g. pine, spruces, firs, and cedars. Wood hardness varies among the conifer species.

The term hardwood is used to describe wood from trees that belong to the angiosperm family. Angiosperms are plants with ovules enclosed for protection in an ovary. When fertilized, these ovules develop into seeds. The hardwood trees are usually broad-leaved; in temperate and boreal latitudes they are mostly deciduous, but in tropics and subtropics mostly evergreen. These leaves can be either simple (single blades) or they can be compound with leaflets attached to a leaf stem. Although variable in shape all hardwood leaves have a distinct network of fine veins. The hardwood plants include e.g. Aspen, Birch, Cherry, Maple, Oak and Teak.

Therefore, in one embodiment, a suitable ligno-cellulosic biomass may be selected from the group consisting of the grasses and woods. In one embodiment, ligno-cellulosic biomass can be selected from the group consisting of the plants belonging to the conifers, angiosperms, Poaceae and families. Another preferred ligno-cellulosic biomass may be that biomass having at least 10% by weight of it dry matter as cellulose, or more preferably at least 5% by weight of its dry matter as cellulose.

The invention claimed is:

1. A continuous process for treating a ligno-cellulosic raw biomass stream, comprising water insoluble contaminants and a ligno-cellulosic biomass comprised of a ligno-cellulosic component, non-ligno-cellulosic water soluble compounds and non-ligno-cellulosic water insoluble compounds, said process comprising the steps of:

a. introducing the ligno-cellulosic raw biomass stream into a separation pool, containing an extraction solution comprising water and dissolved water soluble species and having an extraction solution density, wherein at least a portion of the extraction solution derives from the extraction of a portion of ligno-cellulosic biomass previously treated and contains dissolved water soluble species derived from the non-ligno-cellulosic water soluble compounds of the previously treated ligno-cellulosic biomass;

b. separating the water insoluble components according to their apparent mass densities to create at least a heavy stream comprising at least a portion of the water insoluble contaminants and a light stream comprising at least a portion of the ligno-cellulosic component, wherein the apparent density of the water insoluble in the heavy stream is greater than the extraction solution density and the apparent density of the water insoluble in the light stream is lower than the extraction solution density; and c. removing the light stream from the separation pool, wherein the light stream is removed from the extraction pool by a mechanical removal system extending to an upper position of the extraction pool with respect to the gravity, said mechanical removal system comprising a conveyor belt which extracts the light stream from an outlet zone of the separation pool and drains a dirty liquid stream comprising water and non-ligno-cellulosic water soluble compounds while lifting the light stream to the upper position.

2. The process of claim 1, wherein at least a first portion of the non-ligno-cellulosic water soluble compounds of the ligno-cellulosic biomass is solubilized in the extraction solution.

3. The process of claim 1, wherein the temperature of the extraction solution is in a range of 30° C. to 100° C.

4. The process of claim 1, wherein the ligno-cellulosic raw biomass stream resides in the separation pool for a residence time which is in a range of 30 seconds to 300 minutes.

5. The process of claim 1, wherein the ratio by weight of the ligno-cellulosic biomass present in the separation pool to the extraction solution in the separation pool is less than a value of 1:1000.

6. The process of claim 1, wherein the process further comprises the steps of:

a. draining a dirty liquid stream from the light stream; and b. reintroducing at least a portion of the dirty liquid stream directly into the separation pool.

7. The process of claim 6, wherein the light stream after draining has a free liquid and the percent amount of the free liquid by weight on wet basis in the light stream after draining is less than a value of 20%.

8. The process of claim 6, wherein a portion of the dirty liquid stream directly reintroduced into the separation pool is greater than a value of 50% of the dirty liquid stream.

9. The process of claim 1, wherein the light stream is rinsed with a rinse solution stream comprising water while draining the dirty stream from the light stream.

10. The process of claim 9, wherein the temperature of the rinse solution stream is greater than or equal to the temperature of the extraction solution.

11. The process of claim 9, wherein the ratio of flow of the light stream in Kg/hour on a dry basis to the flow of the rinse solution stream in Kg/hour is less than a value of 1.20.

12. The process of claim 9, wherein at least a second portion of the non-ligno-cellulosic water soluble compounds are solubilized in the dirty liquid stream.

13. The process of claim 9, wherein the rinsing of the light stream occurs in a counter-flow of the rinse solution stream with respect to the light stream.

14. The process of claim 13, wherein at least a portion of the light stream is rinsed with the rinse solution stream while being conveyed by the mechanical removal system.

15. The process of claim 9, wherein the light stream after draining is pressed to produce a pressed light stream and a released stream comprising water and additional water soluble species derived from the non-ligno-cellulosic water soluble compounds.

16. The process of claim 15, wherein the moisture content of the pressed light stream is a value in a range of 40% to 75%.

17. The process of claim 15, wherein released stream is reintroduced into the separation pool.

18. The process of claim 1, wherein the ligno-cellulosic biomass has a bulk density and the bulk density is less than a value of 300 $kg/m^3$.

19. The process of claim 1, wherein the contaminants comprise at least one component selected from the group consisting of stones, silica-containing particles, sand, metal objects.

20. The process of claim 19, wherein the percent amount of the contaminants in the ligno-cellulosic raw biomass stream is less than a value of 10% on a dry weight basis.

* * * * *